United States Patent [19]

Goff et al.

[11] 4,149,065

[45] Apr. 10, 1979

[54] ELECTRIC SPACE HEATER UNIT

[75] Inventors: James E. Goff; Edwin T. Hayes, both of Knoxville; A. J. Seldon Green, Louisville, all of Tenn.

[73] Assignee: Tennessee Plastics, Inc. (TPI), Johnson City, Tenn.

[21] Appl. No.: 770,576

[22] Filed: Feb. 22, 1977

[51] Int. Cl.[2] ..... F24H 9/08; F24H 3/04; H05B 1/02

[52] U.S. Cl. ..... 219/365; 165/155; 165/182; 174/72 C; 219/367; 219/368; 219/530; 219/541; 339/23

[58] Field of Search ..... 219/365–368, 219/374, 375, 541, 530, 540, 342; 174/72 C; 339/21 R, 23, 24; 165/55, 128, 129, 182; 237/79

[56] References Cited

U.S. PATENT DOCUMENTS

| | | | |
|---|---|---|---|
| 2,651,504 | 9/1953 | Gundrum | 165/55 |
| 2,976,389 | 3/1961 | Burger et al. | 219/365 |
| 3,051,816 | 8/1962 | Knoll et al. | 219/365 |
| 3,165,624 | 1/1965 | Cunningham | 219/365 |
| 3,263,746 | 8/1966 | Becher et al. | 165/55 |
| 3,311,163 | 3/1967 | Owen | 165/55 |
| 3,408,480 | 10/1968 | Peltak et al. | 219/367 X |
| 3,543,003 | 11/1970 | Dincher et al. | 219/365 X |
| 3,551,642 | 12/1970 | Knoll | 219/365 X |
| 3,596,058 | 7/1971 | Steiner | 219/367 |
| 3,679,868 | 7/1972 | England | 219/363 X |
| 3,799,248 | 3/1974 | Wenig | 165/55 |
| 3,815,670 | 6/1974 | Shriver | 219/365 X |

FOREIGN PATENT DOCUMENTS

| | | | |
|---|---|---|---|
| 1104191 | 6/1955 | France | 165/55 |

*Primary Examiner*—A. Bartis

*Attorney, Agent, or Firm*—Ostrlenk, Faber, Gerb & Soffen

[57] ABSTRACT

An elongated wall mounted electric space heater is constructed of an elongated trough-like wall box having junction boxes at both ends thereof, and a single subassembly including a finned straight resistance heater element, a housing surrounding the heater element, the housing being elongated and generally rectangular in cross-section and including a U-shaped front cover section secured at the ends of its U-arms to a rear member supporting the heater element, and thermal cutout means mounted on the rear member of the housing and connected in circuit with the heater element. The housing includes apertured upper and lower generally horizontal walls to facilitate the flow of air between the fins of the heater element. Low resistance conductor loops extend into the respective junction boxes and connect opposite ends of the heater element to opposite ends of the thermal contact means.

5 Claims, 5 Drawing Figures

ELECTRIC SPACE HEATER UNIT

U.S. Pat. No. 2,944,138 issued July 5, 1960 to James E. Goff for an Electric Space Heater and Method of Manufacture describes the construction of an elongated electric space heater unit that extends horizontally and is mounted directly on a wall. That heater unit includes a resistance heater conductor clamped directly to a single elongated heat radiating fin. The latter is mounted to an elongated wall box in position spaced from the walls of the box to permit free upward circulation of air over both the front and rear of the heat radiating fin. A baffle is disposed in front of the radiating fin to enhance circulation and a cover is disposed in front of the baffle to protect users from coming in contact with very hot portions of the heater unit.

Pursuant to the instant invention a heater unit is constructed of a wall box and a single subassembly. The latter includes an elongated housing having top and bottom ventilating openings, a resistance heater element extending longitudinally through the housing, and a plurality of transverse radiating fins in heat conducting relationship with the heater conductor. In addition, the assembly includes thermal cutout means secured to the rear of the subassembly housing and connected in parallel with the resistance heater by low impedance conductor means having loop sections formed at opposite ends thereof. The latter extend into terminal boxes at opposite ends of the housing for connection to an energizing circuit.

Accordingly, a primary object of the instant invention is to provide a novel construction for an electric space heater unit which is relatively economical to produce.

Another object is to provide a space heater unit of this type which is relatively compact.

A further object is to provide a space heater unit of this type that is readily installable at a building site.

Still another object is to provide a space heater unit of this type constructed so that the likelihood of damaging the heater element during installation is minimized.

These objects as well as other objects of this invention shall become readily apparent after reading the following description of the accompanying drawings in which.

Figure 2:
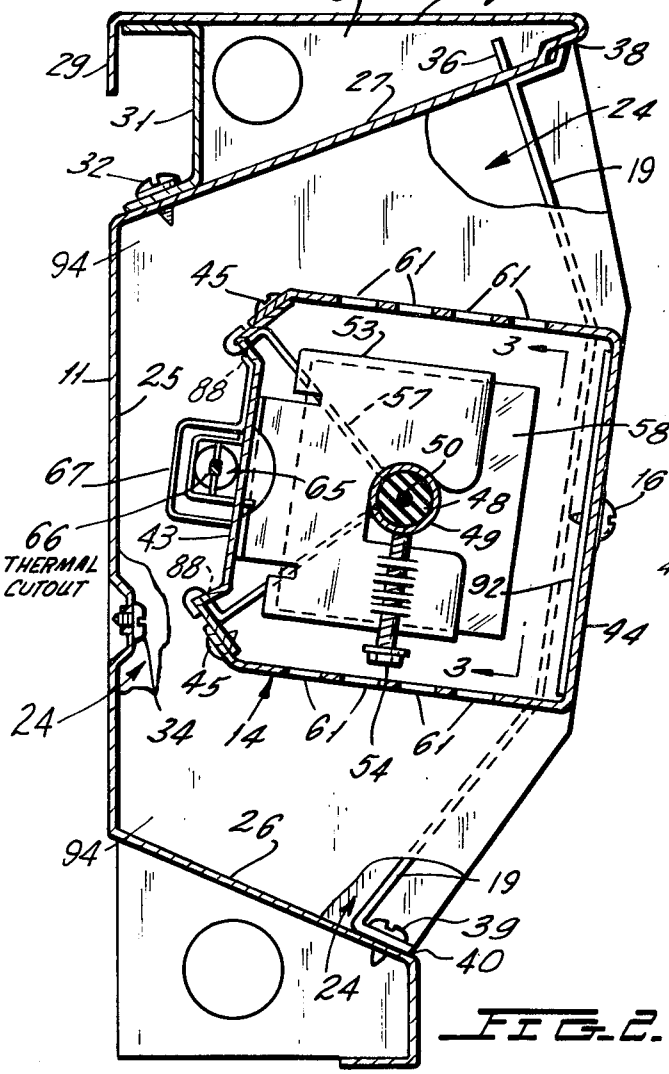
FIG. 2 is a cross-section of the heater unit of FIG. 1 taken through a vertical plane near the center of the heater unit.

Now referring to the drawings. The electric space heater unit of the instant invention is an elongated device adapted to be mounted with its longitudinal axis extending horizontally and its rear surface 11 (FIG. 2) abutting a vertical wall (not shown). Screws or nails (not shown), which extend through rear wall 25 near its upper edge, are used for mounting wall box 12.

The space heater unit consists of wall box 12 and heater subassembly 14 secured to wall box 12 by sheet metal screws 15, 16 which extend through clearance apertures 17, 18 at opposite ends of subassembly 14 and are received by threaded apertures 21, 22 in flanges 91, 92 bent from the respective transverse walls 93, 94 of wall box 12. The latter is an elongated trough-like structure having terminal boxes 23, 24 at opposite ends thereof partially bounded by the respective walls 93, 94. The main central portion of wall box 12 includes rear wall 25, lower inclined wall 26 extending downward and forward from the lower edge of rear wall 25, and upper inclined wall 27 extending forward and upward from the upper edge of rear wall 25. Top flange 28, positioned in a horizontal plane, extends rearward from upper inclined wall 27 with the rear edge of flange 28 terminating in downwardly extending lip 29 that is coplanar with rear wall 25. Elongated stiffening member 31, of modified U-shaped cross-section, extends between the lower surface of flange 28 and the rear surface of upper inclined wall 27, being secured to the latter by a plurality of screws 32. In addition, stiffening member 31 provides a cover for wireway 33 formed between flange 28 and wall 27.

An individual grounding screw 34 is provided in the rear boundary wall for each of the junction boxes 23, 24. Each of the boxes 23, 24 is provided with a removable cover 19 formed with a pair of tabs 36, 37 that extend behind section 38, which joins the forward edges of wall 27 and flange 28, to position the upper edge of cover 19. Sheet metal screw 39 extends through clearance aperture 41 in forwardly extending flange 40 along the lower edge of cover 19 and is received by threaded aperture 42 of wall box 12 to fasten cover 19 in closed position.

Heater subassembly 14 includes an elongated housing of generally rectangular cross-section constructed of rear member 43 and U-shaped member 44 having the free ends of its U-arms fastened by sheet metal screws 45 to rear member 43 along opposite edges thereof. When subassembly 14 is mounted to wall box 12, the inner surface of the web of U-shaped member 44 abuts flanges 91, 92.

Extending longitudinally generally through the center of housing 43, 44, is a heating element comprising resistance wire heater 50 surrounded by aluminum tube 49 and insulated therefrom by a relatively good heat conducting insulator 48, such as magnesium oxide. The heating element 48, 49, 50 is positioned by end brackets 51, 52 and central bracket 53 all of which are secured to rear wall 43 and extend forward therefrom. Screw 54 is threadably mounted to central bracket 53 and engages the outer surface of tube 49 to prevent longitudinal movement of heater wire 50. Each end of tube 49 extends through a plastic bushing 55 secured to end brackets 51, 52 by individual push nut 56. The position of tube 49 is further stabilized by V-shaped spring wire retainers 57 which extend around tube 49. Each retainer 57 is provided with reversely bent ends which extend through spaced holes 88 in rear member 43 and engage portions of rear member 43. Spaced along the length of tube 49, and secured thereto in heat conducting relationship, are a plurality of rectangular fins 58 disposed in generally vertical planes so that air circulating through top and bottom ventilating openings 61 of housing member 44 flows across the major surfaces of heat radiating fins 58.

Figure 1:
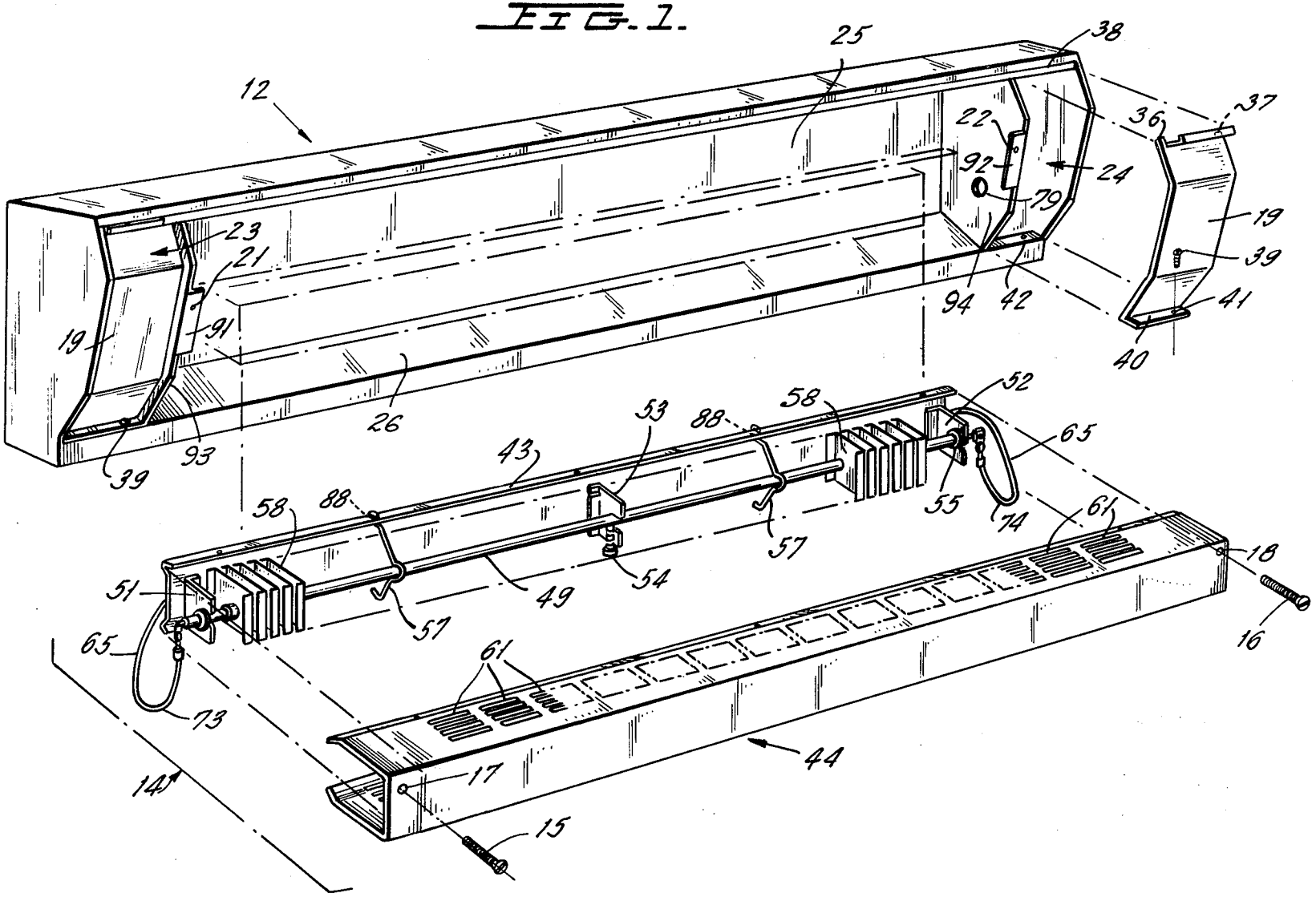
FIG. 1 is an exploded perspective of an electric space heater unit constructed in accordance with teachings of the instant invention.
Figure 4:
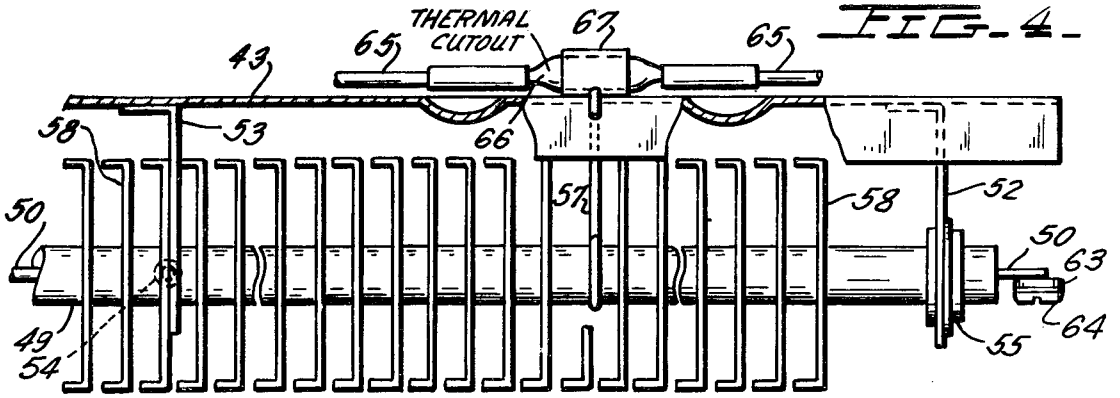
FIG. 4 is a plan view, partly sectioned of the elements shown in FIG. 3.
Figure 3:
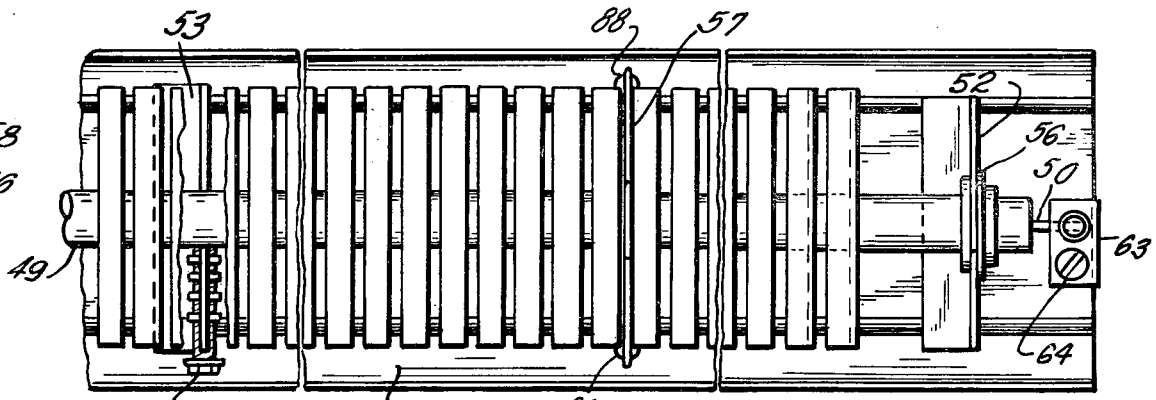
FIG. 3 is a fragmentary front elevation of the heater subassembly looking in the direction of arrows 3—3 of FIG. 2 with the front cover of the subassembly removed.
Figure 5:
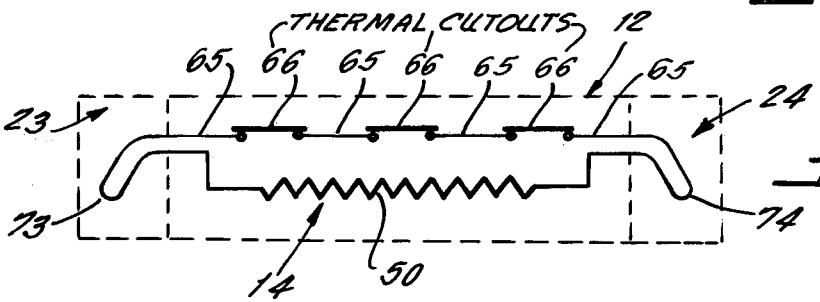
FIG. 5 is an electrical schematic of the space heater unit of FIG. 1.

Each end of wire heater 50 is provided with a terminal 63 welded thereto. Clamping screws 64 threadably mounted to terminals 63 connect relatively low resistance insulated conductor means 65 to each end of resistance wire heater 50. The sections of low resistance conductor 65 connect three thermal cutouts 66 in a series combination. The end portions of low resistance conductor are formed into loops 73, 74 which connect opposite ends of the series connected cutouts 66 to opposite ends of resistance wire heater 50 when heater unit 12, 14 is shipped from the factory (FIG. 5). Thermal cutouts 66 are spaced along the length of rear member 43 being secured to the rear surface thereof by individual clamps 67 (FIG. 4). Loops 73, 74 which are entered into the respective junction boxes 23, 24 through side openings 79. The particular junction boxes 23, 24 used for connecting resistance wire heater 50 to an energizing circuit is a matter of convenience for the installer. If junction box 23 is chosen then conductor 65 is cut at loop 73 and splicing is done at the cut ends in a manner such that the series combination of thermal cutouts 66 is in series with resistance wire heater 50. When junction box 24 is chosen for wiring then conductor 65 is cut at loop 74.

Thus, it is seen that the instant invention provides a simplified construction for an electric space heater unit in which heater subassembly 14 is readily mounted by utilizing the two screws 15, 16 so that wall box 12 may be secured in position without taking any precautions to protect the electrical parts.

Although a preferred embodiment of this invention has been described, many variations and modifications will now be apparent to those skilled in the art, and it is therefore preferred that the instant invention be limited not by the specific disclosure herein but only by the appended claims.

What is claimed is:

1. An elongated electric space heater unit adapted to be mounted on and in front of a vertical mounting surface with the longitudinal axis of the unit positioned horizontally; said unit including an elongated trough-like wall box and an elongated heater subassembly secured to said wall box; said wall box including a generally vertical rear wall, an elongated upper inclined wall sloping forward and upward from the upper edge of said rear wall, and an elongated lower inclined wall sloping forward and downward from the lower edge of said rear wall; said rear wall, said upper inclined wall and said lower inclined wall being formed from a single element; said heater subassembly including an elongated housing generally of rectangular cross-section and having upper and lower ventilating openings in respective upper and lower horizontal walls of said housing, an elongated sheathed electric resistance heating element disposed within said housing, spaced vertically disposed fins extending transverse to said heating element and mounted within said housing in heat conducting relationship with said heating element, and thermal cutout means disposed at the rear of said housing and being connected in electrical circuit with said heating element; said housing being positioned in front of and spaced from said rear wall; said housing also positioned in confronting spaced relationship with respect to the front surfaces of said upper and lower inclined walls; said housing including a front cover section of generally U-shaped cross-section and an elongated rear section secured to the cover section at the ends of its U-arms; and means effective prior to securement of said cover section to said rear section to secure said heating element to said rear section against longitudinal and transverse movement of said heating element relative to said rear section.

2. An electric space heater unit as set forth in claim 1 in which said heater subassembly also includes said thermal cutout means and conductor means connecting said cutout means in circuit with said heating element.

3. An electric space heater unit as set forth in claim 2 in which the wall box at opposite ends thereof is provided with respective first and second terminal boxes; said conductor means including first and second looped sections disposed within the respective first and second terminal boxes; said first and second looped sections respectively, connecting opposite ends of said thermal cutout means directly to opposite ends of the heating element.

4. An electric space heater unit as set forth in claim 3 in which the wall box includes an elongated top flange formed integrally with and extending rearward from the upper edge of said upper inclined wall; an elongated lip formed integrally with and extending along the rear edge of said top flange positioned substantially coplanar with said rear wall; an elongated stiffening member interposed between the top flange and the rear surface of said upper inclined wall.

5. An electric space heater unit as set forth in claim 1 in which the wall box includes an elongated top flange formed integrally with and extending rearward from the upper edge of said upper inclined wall; an elongated lip formed integrally with and extending along the rear edge of said top flange positioned substantially coplanar with said rear wall; an elongated stiffening member interposed between the top flange and the rear surface of said upper inclined wall.

* * * * *